US012631079B2

(12) United States Patent
Bhudolia et al.

(10) Patent No.: US 12,631,079 B2
(45) Date of Patent: May 19, 2026

(54) DOWNHOLE SEALS HAVING TEMPERATURE RESISTANCE

(71) Applicant: Halliburton Energy Services, Inc., Houston, TX (US)

(72) Inventors: Somen Kumar Bhudolia, Singapore (SG); Sandeep Thatathil, Singapore (SG); Michael Linley Fripp, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/227,494

(22) Filed: Jul. 28, 2023

(65) Prior Publication Data

US 2025/0034961 A1 Jan. 30, 2025

(51) Int. Cl.
*E21B 23/06* (2006.01)
*E21B 33/12* (2006.01)

(52) U.S. Cl.
CPC ..... *E21B 23/06* (2013.01); *E21B 33/1208* (2013.01)

(58) Field of Classification Search
CPC ..... E21B 33/1208
See application file for complete search history.

(56) References Cited

U.S. PATENT DOCUMENTS 3,313,349 A * 4/1967 Page, Jr. ..... E21B 34/105 137/395
5,603,511 A * 2/1997 Keyser, Jr. ..... E21B 33/1216 277/638
6,203,020 B1 3/2001 Mireles, Jr. et al.
9,174,393 B2 11/2015 Bartel et al.
9,534,138 B2 1/2017 Economy et al.
10,526,465 B2 1/2020 Meyer et al.
11,130,293 B2 9/2021 Meyer et al.
11,254,032 B2 2/2022 Lan et al.
2005/0109502 A1* 5/2005 Buc Slay ..... B82Y 30/00 166/179
2005/0161212 A1 7/2005 Leismer et al.
2009/0152817 A1* 6/2009 Du ..... F16L 7/02 277/315
2014/0124193 A1* 5/2014 Rowe ..... E21B 33/1212 166/115
2014/0361497 A1* 12/2014 Porta ..... E21B 33/1208 277/619
2015/0284586 A1 10/2015 Economy et al.
2015/0344688 A1 12/2015 Drake et al.
2019/0040220 A1* 2/2019 Meyer ..... C08J 9/0076
2019/0234180 A1* 8/2019 Frazier ..... E21B 34/063
2020/0023598 A1 1/2020 Lan et al.
2021/0230965 A1 7/2021 Zhong et al.
2022/0003067 A1 1/2022 Glaesman
(Continued)

OTHER PUBLICATIONS

ATSP Innovations—Self-Bond (TM ) (Year: 2018).*
(Continued)

*Primary Examiner* — Giovanna Wright
(74) *Attorney, Agent, or Firm* — Scott Richardson; C. Tumey Law Group PLLC

(57) ABSTRACT

A variety of methods and apparatus are disclosed, including, in one embodiment, a downhole tool for use in a borehole, comprising: a mandrel; and a sealing element disposed about the mandrel, wherein the sealing element comprises an aromatic copolyester thermoset (ACT).

16 Claims, 10 Drawing Sheets

(56) References Cited

U.S. PATENT DOCUMENTS

2022/0074400 A1* 3/2022 Zhou ..... F04B 39/0022
2024/0359403 A1* 10/2024 Vaught ..... B29C 64/209

OTHER PUBLICATIONS

International Search Report and Written Opinion for International Patent Application No. PCT/US2023/030133 dated Apr. 19, 2024. PDF file. 8 pages.
Bashandeh, K., Lan, P. & Polycarpou, A.A. Tribology of self-lubricating high performance ATSP, PI, and PEEK-based polymercomposites up to 300° C. Friction 11, 141-153 (2023).
Shau, Abhra & Jana, Chhayarani & De, P & Ray, P . . . (2012). Aspects of polymers and polymeric composites in chemicalprocess industries.
Maghsoudi, Khosrow; Vazirinasab, Elham; Momen, Gelareh; Jafari, Reza (2020). Advances in the Fabrication of Superhydrophobic Polymeric Surfaces by Polymer Molding Processes. Industrial & Engineering Chemistry Research, ( ), acs.iecr.0c00508-.
ATSP Innovations, Estherm-advanced aromatic polyesters, 2018.
ATSP Innovations, Inc. Jacob Meyer, PhD, Assembly and Reuse of Aromatic Thermosetting Copolyester, 2021.
Compositesworld, Malnati, New Polymer expands composites options in demanding environments, Feb. 2022.
Plastics Technology, Sherman, Unique Class of Polymers behave like Crosslinked Thermosets and Process like Thermoplastics, 2020.

* cited by examiner

DOWNHOLE SEALS HAVING TEMPERATURE RESISTANCE

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface.

A typical operation concerning downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a wellbore. Substantial pressure differentials across a seal may induce failure of the seal and may result in substantial loss of time, money, and equipment, and may even result in harm to individuals. Additionally, expanding a wellbore seal may induce substantial deformation and internal stress on a sealing element, which may increase the chance of failure (e.g., due to breaking or tearing). The design and manufacture of wellbore seals may be limited in structure and material choice in order to minimize the chance of failure. It may be suitable to explore alternative manufacturing processes to produce improved sealing elements.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
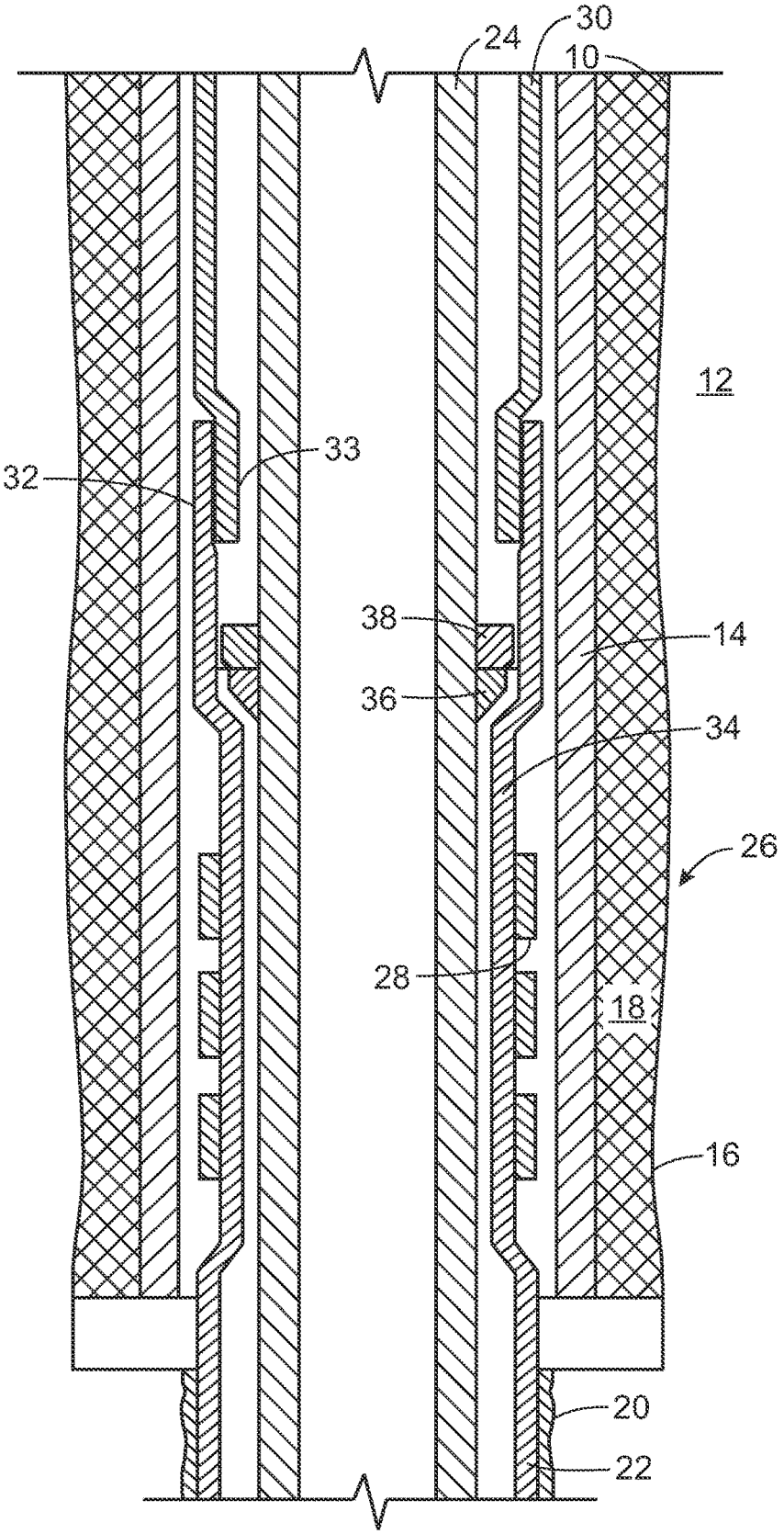
FIG. 1 is a diagram of an expandable liner hanger (ELH) having a seal (sealing element) fabricated from aromatic copolyester thermoset (ACT) that can be an aromatic thermosetting copolyester (ATSP).

Disclosed herein are sealing elements that include an aromatic copolyester thermoset (ACT), such as an aromatic thermosetting copolyester (ATSP) available from ATSP Innovations, LLC having headquarters in Houston, Texas, USA. The ACT can be labeled as a resin or as a polymer. The ACT is formed by crosslinking oligomers that are lower molecular weight than the ACT. Both the oligomers (before crosslinking) and the ACT (as a thermoset after crosslinking) can have the following structure in a repeat unit of the main chain of the chemical structure:

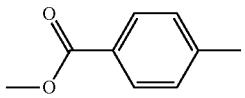

which includes the aromatic ring (benzene ring). Also, the depicted structure includes a carbon single bonded to an oxygen, double bonded to another oxygen, and single bonded to a carbon of the aromatic ring.

Thus, the ACT (e.g., ATSP) includes an aromatic polyester backbone. The oligomers and the ACT may be carboxylic acid-capped (capped with a carboxylic acid functional group as end group) or acetoxy-capped (capped with an acetoxy functional group as an end group). The crosslinked network of the ACT morphology may be composed of an aromatic polyester backbone interconnected via covalent single/double oxygen bonds. At least a portion of the ACT (e.g., ATSP) matrix is generally amorphous.

Examples of elastomers or elastomer material utilized as an elastomer seal or elastomer sealing element include natural rubbers, styrene-butadiene block copolymers, polyisoprene, polybutadiene, ethylene propylene rubber, ethylene propylene diene rubber, silicone elastomers, fluoroelastomers, polyurethane elastomers, and nitrile rubbers. Examples of non-elastomeric material utilized for downhole seals or back-up rings include polyphenylene sulfide (PPS), polyether ether ketone (PEEK), and polytetrafluoroethylene (PTFE).

Elastomeric seals and non-elastomeric backup rings are utilized in downhole applications and may perform well in terms of sealing and chemical resistance but can have a limited glass transition temperature and thus may not be recommended for use in high temperature environments (e.g., greater than 200° C.). For certain geothermal well conditions, there is a need for alternative seal and backup materials that are mechanically durable and thermally stable at higher temperatures (e.g., greater than 200° C.) without significant compromise in their chemical resistance.

In response, embodiments herein provide for seals and downhole tools having seal material that includes ACT having a glass transition temperature ($T_g$) up to 307° C., e.g., in the range of 267° C. to 307° C., and in which the seals can withstand temperatures up to 350° C. The ACT generally does not thermally degrade at temperatures below 500° C. Embodiments include seal stacks having a sealing element (seal) that includes ACT, an O-ring or O-ring backup that includes ACT, a packer element (packer sealing element) or packer element backup that includes ACT, and other similar applications.

The ACT polymer or resin system has a high $T_g$ and thermal stability and is included herein as a seal material for downhole tools to give a downhole seal and/or downhole seal backup solution. In certain implementations, the ACT can be an alternative to existing non-elastomeric seal solutions such as PPS, PEEK, and PTFE. Embodiments include pristine non-elastomeric seals made from ACT able to withstand high downhole temperatures up to 350° C., such as withstanding maximum temperatures within the ranges of 300° C. to 350° C., or 320° C. to 350° C. Typically, non-elastomeric seals can operate at temperatures somewhat above the $T_g$, including for existing PEEK and other thermoplastics.

Embodiments include reinforced seals made from the ACT with fiber reinforcement. The fiber reinforcement may be, for example, glass and/or carbon fiber reinforcement, giving improved mechanical properties. The sealing element (seal or backup) may include reinforcement material including fibers that are mixed with or dispersed in the ACT to reinforce the ACT. Further, embodiments include ACT bonded seals where ACT seals or backups are bonded to elastomeric seals and/or metallic inserts, and are utilized as a bonded seal or as a component of a composite seal. Again, the term ACT as used herein can encompass ATSP.

In implementations, seals or backup seals can be machined from billets made from injection, extrusion, or compression molding of the ACT. ACT resin cast seals can also be applicable due to the thermosetting properties of the ACT. ACT is generally considered a non-elastomeric material as not an elastomer material. Elastomers are made of a long chain of molecules and generally have an elastic strain greater than 100% with no permanent deformation.

Choosing the seal material is a consideration for effective sealing of downhole tools in oil and gas applications. The hydrocarbon production relies on sealing systems capable of operating in high pressure and high temperature scenarios. The exposure to high temperature and high pressure benefits from new material systems that have ability to withstand the demanding environments. High temperature and high pressure scenarios may generally rely on a complimentary or a back-up seal to the primary elastomeric seals to achieve an effective sealing effect. High performance thermoplastics, such as like PEEK, PPS and PTFE, are often utilized for sealing and backup in oil and gas applications. These high performance thermoplastics are often used as sealing material because they have good chemical resistance. In implementations, PEEK is most favored for sealing applications as PEEK is generally able to withstand high temperature and high-pressure environment. The usage of thermoplastics is generally beneficial including leading to less downtime and maintenance along with improved reliability. However, the present techniques of utilizing ACT based pristine seal and backup may accommodate generally more extreme high temperature-high pressure environments in implementations.

The usage of elastomeric seals is typically restricted for high pressure applications as they are unable to withstand high pressure without a backup. For instance, ethylene propylene diene monomer (EPDM) rubber seals can withstand temperature up to 300° C. but there may be inadequate backup to be employed to withstand the high pressure. In such a scenario or similar scenarios, ACT backups can be a beneficial solution in implementations (withstanding temperatures up to 350° C.). Again, the ACT material may be utilized for seal stacks (e.g., FIGS. 3A, 3B, and 4), O-ring backup (e.g., FIGS. 5, 6A, and 6B), packer element backup, and other similar applications. These seals can be pristine ACT or ACT reinforced with different compositions of reinforcement. In certain implementation, utilization of ACT-based seals may facilitate to reach greater depth in subterranean formations and potentially explore new hydrocarbon reservoirs that may not be feasible with typical non-elastomeric seal solutions.

FIG. 1 depicts an expandable liner hanger (ELH) than can incorporate seals (sealing elements) fabricated from ACT. An ELH can be characterized as a downhole tool in being a cementing tool. Cement may be employed (injected) to install (secure) casing in a wellbore and prevent migration of fluids in the annulus between the casing and the wellbore wall.

Once an upper portion of the wellbore has been drilled and cased, it may be desirable to continue drilling and to line a lower portion of the wellbore with a liner lowered through the upper cased portion thereof. Liner hangers are typically used to mechanically support an upper end of the liner from the lower end of a previously installed casing. Additionally, liner hangers may be used to seal the liner to the casing.

ELHs typically utilize elastomeric rings (e.g., rings made of rubber) as seals or sealing elements carried on a section of expandable tubing to provide both mechanical support and a fluid seal. Accordingly, once an ELH is placed at a desired position downhole within a casing, an expansion cone may be forced through the ELH. The expansion cone expands the elastomeric rings of the ELH, bringing the rings (seals) into contact with the casing to provide both mechanical support and a fluid seal between the casing and a liner.

As shown in FIG. 1, a borehole as wellbore 10 may be drilled through the Earth surface into a subterranean formation in the Earth crust. A casing 14 may be placed in an upper portion 16 of the wellbore 10 and held in place by cement 18 that is injected between the casing 14 and the upper portion 16 of wellbore 10 wall (formation 12 face in this example). Once the casing 14 is installed, the casing 14 can be considered the wellbore 10 wall of the upper portion 16. With the casing 14 installed, the upper portion 16 may be called a cased borehole or cased wellbore. The inner (inside diameter) surface of the casing 14 may be considered the inner surface (inside diameter) of the wellbore 10 in the upper portion 16.

Below casing 14, a borehole as a lower portion 20 of the wellbore 10 may be drilled through casing 14. The lower portion 20 may have a smaller diameter than the upper portion 16. A length of liner 22 is shown positioned within the lower portion 20. The liner 22 may line or case the lower portion 20 and/or be utilized to drill the lower portion 20. If desired, cement 18 may be placed between the liner 22 and the lower portion 20 of wellbore 10. The cement 18 may be placed between the liner 22 and the wellbore 10 wall or formation 12 face of the wellbore 10. The liner 22 may be installed in the wellbore 10 via (by means of) a work string 24. The work string 24 may include a releasable collet (not shown) by which the work string 24 can support and rotate the liner 22 as it is placed in the wellbore 10.

Attached to the upper end of, or formed as an integral part of, liner 22 is a liner hanger 26 which may include a number of annular seals 28 (sealing elements). To provide for adequate flexibility of the seals 28 if ACT, the thickness may be adjusted and other implementation factors considered. The seals 28 may form a seal with the inside surface of the casing 14 as an adjacent surface. While three seals 28 are depicted for illustrative purposes, any number of seals 28 may be used. A polished bore receptacle 30 (or tie back receptacle) may be coupled to the upper end of the liner hanger 26. In one embodiment, the polished bore receptacle 30 may be coupled to the liner hanger 26 by a threaded joint 32, but in other embodiments a different coupling mechanism may be employed. The inner bore of the polished bore receptacle 30 may be smooth and machined to close tolerance to permit work strings, production tubing, etc. to be connected to the liner 22 in a fluid-tight and pressure-tight manner. For instance, a work string may be connected by means of the polished bore receptacle 30 and used to pump fracturing fluid at high pressure down to the lower portion 20 of the wellbore 10 without exposing the casing 14 to the fracturing pressure.

It may be desirable that the outer diameter of liner 22 be as large as possible while being able to lower the liner 22 through the casing 14. It may also desirable that the outer diameter of the polished bore receptacle 30 and the liner hanger 26 be about the same as the diameter of liner 22. In the run in condition, the outer diameter of liner hanger 26 is defined by the outer diameter of the annular seals 28. In the run in condition, a body or mandrel 34 of liner hanger 26 has an outer diameter reduced by about the thickness of the seals 28 so that the outer diameter of the seals is about the same as the outer diameter of liner 22 and tie back receptacle 30.

In this implementation, first and second expansion cones 36 and 38 may be carried on the work string 24 just above the reduced diameter body 34 of the liner hanger 26. Fluid pressure applied between the work string 24 and the liner hanger 26 may be used to drive the cones 36, 38 downward through the liner hanger 26 to expand the body 34 to an outer diameter at which the seals 28 are forced into sealing and supporting contact with the casing 14. The first expansion cone 36 may be a solid, or fixed diameter, cone having a fixed outer diameter smaller than the inner diameter 33 of the threaded joint 32. In the run in condition, second expansion cone 38 may have an outer diameter greater than first cone 36 and also greater than the inner diameter 33 of the threaded joint 32. In an embodiment, the second expansion cone 38 may be collapsible, that is, may be reduced in diameter smaller than the inner diameter 33 of the threaded joint 32 when it needs to be withdrawn from the liner hanger 26. In some contexts, the second expansion cone 38 may be referred to as a collapsible expansion cone. After the liner hanger 26 is expanded, expansion cones 36, 38 may be withdrawn from the liner hanger 26, through the polished bore receptacle 30 and out of the wellbore 10 with the work string 24.

The seals 28 may be made, for example, of elastomeric material, such as rubber. Yet, elastomeric material may be susceptible to degradation as a result of exposure to downhole temperatures and pressures. Therefore, in embodiments herein, the seals 28 are made of an aromatic copolyester thermoset, such as ACT.

Figure 2:
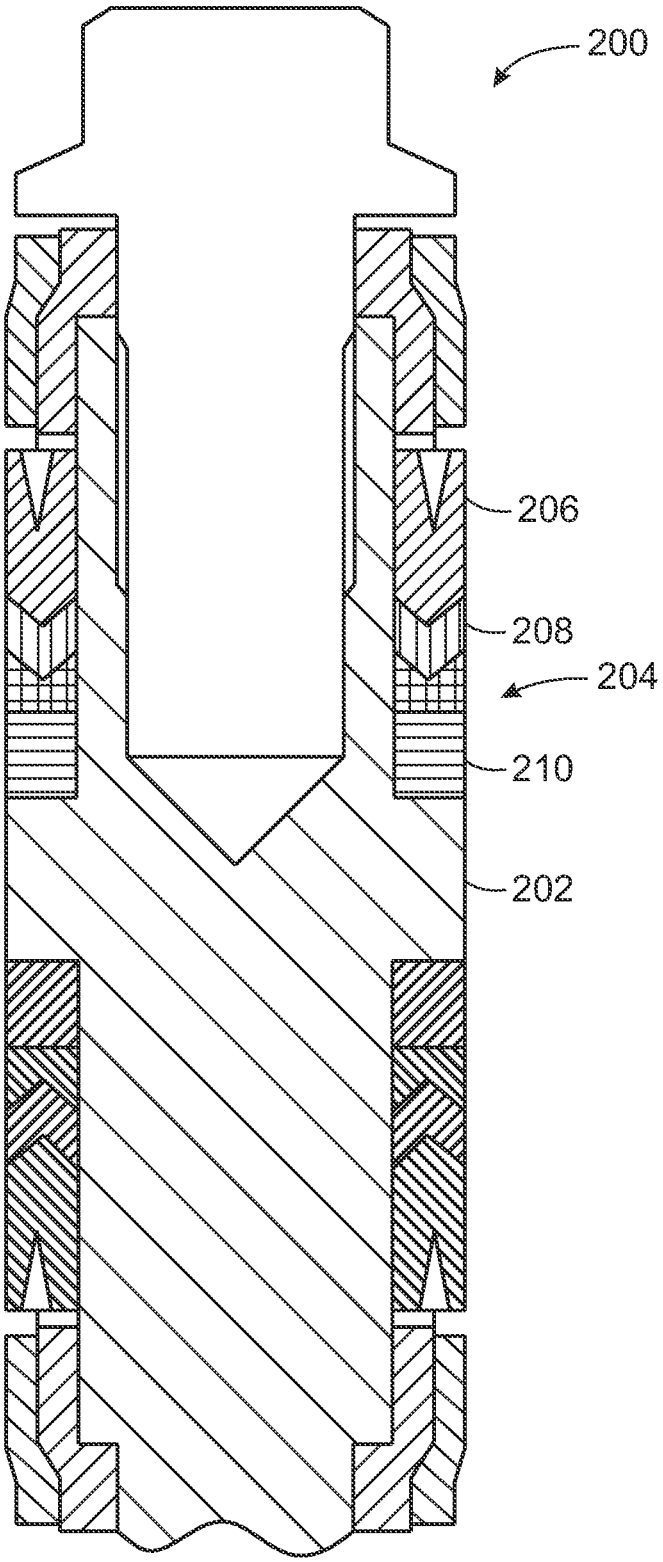
FIG. 2 is a diagram of a downhole tool have a sealing element including ACT.

FIG. 2 is a downhole tool 200 to be disposed in a borehole (e.g., wellbore 10 of FIG. 1). The downhole tool 200 (e.g., packer) as installed in the wellbore may be permanently set or retrievable, mechanically set, hydraulically set, and/or combinations thereof. A retrievable packer may be a type of packer that is run and retrieved on a running string or production string, unlike a permanent production packer that is set in the casing or liner before the production string is run.

A packer may be device that can be run into a wellbore with a smaller initial outside diameter that then expands externally to seal the wellbore. Packers may employ flexible, elastomeric elements that expand. A packer may be a production packer, test packer, isolation packer, etc. A production packer may isolate the annulus (e.g., between the production tubing and the wellbore wall) and anchor or secure the bottom of the production tubing string. A typical packer assembly incorporates a means of securing the packer against the casing or liner wall, such as a slip arrangement, and a means (e.g., sealing elements) of creating a reliable hydraulic seal to isolate the annulus, typically by means of an expandable elastomeric element. Packers are typically classified by application, setting method and possible retrievability.

The downhole tool 200 (e.g., packer) may include a mandrel 202 (tool mandrel) and a seal stack 204 disposed about the mandrel 202. The seal stack 204 may be an assembly of individual sealing elements 206, 208, 210 utilized to seal off a portion of wellbore 10. One or more of the sealing elements 206, 208, 210 may be or include ACT. As in the illustrated implementation, the individual sealing elements 206, 208, 210, within seal stack 204 may be of differing size, height, and/or shape. Without limitation, a shape may include, for example, cross-sectional shapes that are circular, elliptical, triangular, rectangular, square, hexagonal, and/or combinations thereof.

The material selection for the sealing elements may be to tailor properties of the sealing elements 206, 208, 210, such as hardness, elasticity, gas resistance, chemical resistance, temperature resistance, and high temperature strength, among others. The ACT can have beneficial mechanical properties, such as a tensile strength of at least 90 MPa (e.g., in the range of 90 MPa to 110 MPa) and tensile modulus of at least 3.5 GPa (e.g., in the range of 3.5 GPa to 5 GPa), which is comparable to PEEK and generally greater than PPS and PTFE. The strain to failure of the ACT is typically at least 8% (e.g., in the range of 8% to 12%), which is comparatively lower to PEEK (about 35%) and PTFE (about 300%) whilst higher than PPS (2-4%). The tensile strength, tensile modulus, and strain to failure can be measured, for example, per American Society for Testing and Materials (ASTM) standard D638-22 "Standard Test Method for Tensile Properties of Plastics" (last updated Jul. 21, 2022) of ASTM international, or International Organization for Standardization (ISO) 527-2:2012 "Plastics—Determination of tensile properties—Part 2: Test conditions for moulding and extrusion plastics" (published 2012 February) last reviewed and confirmed in 2017.

In implementations, the glass transition temperature of the ACT resin is 267° C. to 307° C., which is higher than conventionally-used PEEK as a high-performance sealing material. The ACT can have good resistance to chemicals such as acetic acid, formic acid, hydrochloric acid, and other typical chemicals utilized for oil and gas applications. The crosslinked network of the ACT consists of an aromatic polyester backbone interconnected via covalent single/double oxygen bonds which enables outstanding chemical inertness.

The mechanical properties (e.g., tensile strength and modulus) of ACT are similar to that of high temperature thermoset epoxies. Yet, the strain to failure of typical thermoset like epoxy is low (1-5%) which limits their application as a sealing material. For thermosetting epoxies, the maximum service temperature in presence of formic acid (up to 25% concentration by weight), acetic acid (up to 25% concentration by weight) and hydrochloric acid (up to 25% concentration by weight) is limited to 100° C. The aromatic copolyester thermoset resin can be utilized at the service temperature of at least 150° C. in presence of these acids up to 25% concentration by weight. Based on the chemical immersion studies in acetic acid (10% concentration by weight) at room temperature for 7 days, high performance epoxy resin has shown 30% loss in Shore D hardness and incurred swelling with 6% increase in mass was reported. The ACT will have insignificant change in hardness and mass in these immersion conditions. Shore D hardness can be measured, for example, per ASTM D2240-15 (2021) "Standard Test Method for Rubber Property-Durometer Hardness" (last updated Jul. 23, 2021) of ASTM international, or ISO 48-4:2018 "Rubber, vulcanized or thermoplastic-Determination of hardness-Part 4: Indentation hardness by durometer method (Shore hardness)" (published 2018 August).

Aromatic copolyester thermoset resin can be used at the service temperature of at least 150° C. (e.g., 150° C. to 200° C.) in presence of formic acid (up to 25% concentration by weight), acetic acid (up to 25% concentration by weight) and hydrochloric acid (up to 25% concentration by weight) which is higher than the maximum 100° C. for high temperature epoxy resin systems. The ACT resin will have insignificant change (e.g., less than 0.5% loss) in Shore D hardness and insignificant change (e.g., less than 0.5% increase by swelling) in mass when immersed in acetic acid (10% concentration by weight) at room temperature for 7 days. Again, for conventional epoxy resin, there can be 30% loss in Shore D hardness and 6% change (increase by swelling) in mass under those conditions.

In implementations, the ACT utilized as a sealing material has glass transition temperature of at least 170° C., such as in the range of 170° C. to 307° C., which is higher than high performance thermoplastics and conventional thermoset resin systems used for sealing materials in downhole applications. In implementations, the ACT utilized as a sealing material has a tensile strength of at least 90 MPa and a tensile modulus of at least 4 GPa, which is comparable to high performance thermoplastic PEEK, higher than PPS and PTFE, and comparable to or higher than conventional thermoset resin systems such as epoxy, vinyl-esters etc. In implementations, the ACT utilized as a sealing material has strain to failure of at least 8%, which is lower than PEEK and PTFE but higher than PPS and conventional thermoset epoxy systems. In implementations, the ACT utilized as a sealing material has similar chemical resistance compared to high performance thermoplastics, such as PEEK.

Figures 3A, 3B:
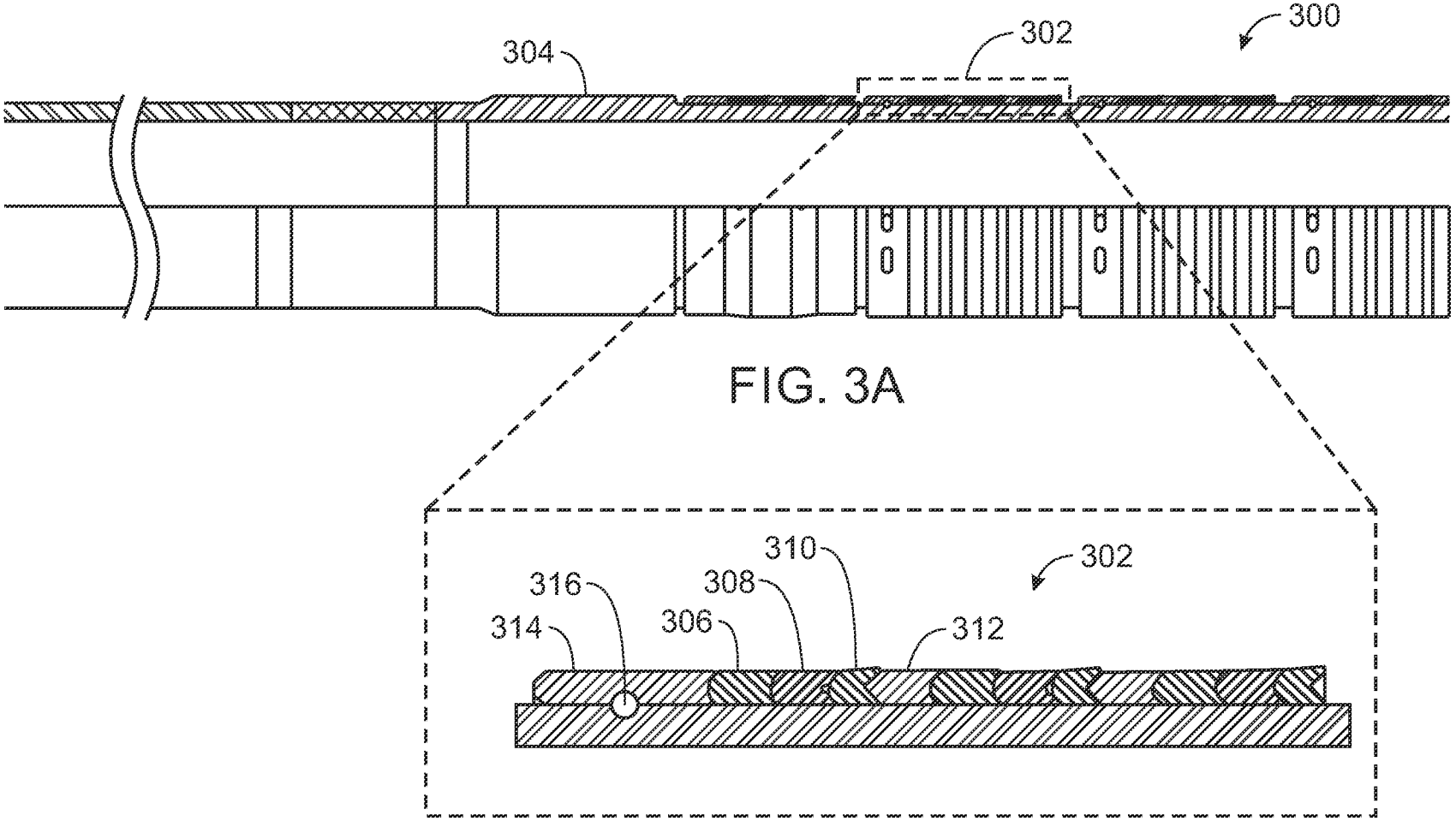
FIG. 3A is a diagram of a downhole tool having a seal stack on a mandrel and in which the seal stack has seal(s) including ACT.
FIG. 3B is a diagram of the seal stack of FIG. 3A.

FIG. 3A is a downhole tool 300 for a borehole (e.g., wellbore 10 of FIG. 1). The downhole tool 300 includes the seal stack 302 on a mandrel 304 (tool mandrel). The seal stack 302 includes ACT. The downhole tool 300 may be, for instance, a packer (e.g., production packer, isolation packer, etc.) to be installed in the wellbore. A seal stack generally has multiple seals with different respective materials to give different properties. In application, the seal stack 302 provides for a fluid seal in the wellbore between the seal stack 302 and the wellbore wall, thereby isolating (e.g., the annulus) downhole of the downhole tool 300 from uphole of the downhole tool 300.

FIG. 3B is the seal stack 302 on the mandrel 304. FIG. 3B is an exploded view of the noted portion of FIG. 3A. The seal stack 302 includes seals 306, 308, 310 (e.g., rings) and spacer 312 (e.g., ring). The seals 306, 308, 310 may be sealing elements that provide for a fluid seal in the wellbore between the seals 306, 308, 310 and the wellbore wall (e.g., casing). The seal stack 302 includes an end portion 314 and an O-ring 316. In implementations, the seal 306 includes ACT (with or without reinforcement material, such as fibers). In one implementation, the seal 308 includes ACT, the seal 308 includes rubber, and the seal 310 includes rubber that is softer than the rubber of seal 308.

Figure 4:
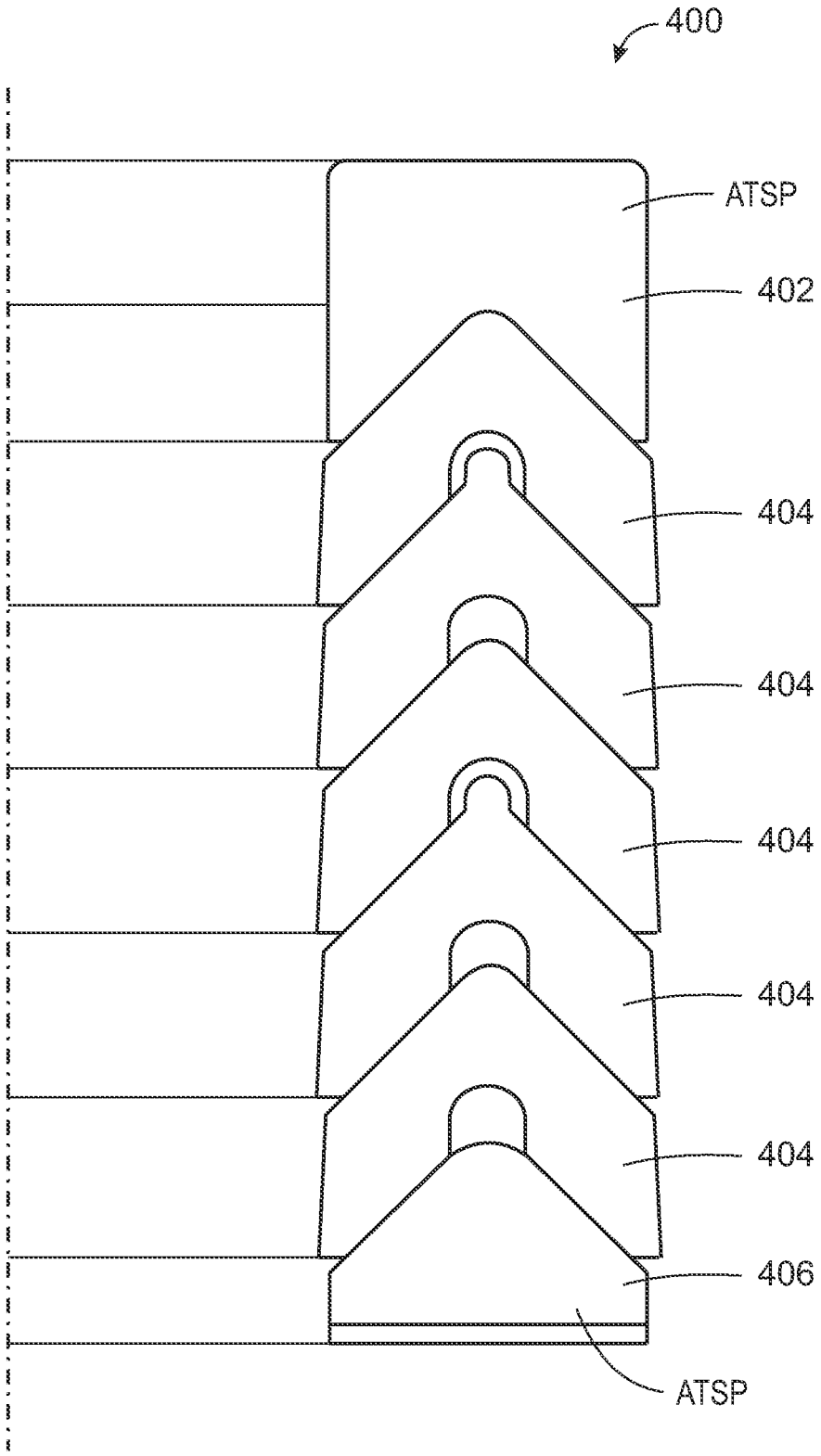
FIG. 4 is a seal stack that may be employed on a downhole tool for a wellbore, and in which the seal stack includes ACT.

FIG. 4 is a seal stack 400 that may be employed on a downhole tool for a wellbore. The seal stack 400 may be situated on a mandrel of the downhole tool. The depicted is half of the cross section of the seal stack 400. The middle center line to the left shows the line of symmetry and the horizontal lines are the matching lines of the edge of each layers.

The seal stack 400 may provide for a fluid seal between the downhole tool and the wellbore wall, such that in the borehole annulus, uphole of the downhole tool is fluidically sealed from downhole of the downhole tool.

The seal stack 400 includes a top seal 402 for uphole position, multiple seals 404, and a bottom seal 406 on downhole side. In the illustrated implementation, the multiple seals 404 are five seals but can be more or less than five seals. The multiple seals 404 can each be, for example, a Vee Ring or V-Ring, or the like. The multiple seals 404 can each be, for example, PTFE or a mixture of PTFE and elastomer(s), or similar material. The seals 404 may provide resilience, sealing efficiency, and extrusion resistance.

In implementations, the top seal 402 is a top adapter or anti-extrusion backup ring to resist extrusion. To resist extrusion, the top seal 402 may have a higher temperature resistance than the multiple seals 404 and/or a higher Young's modulus than the multiple seals 404. The top seal 402 can be, for example, a thermoplastic (e.g., PEEK) or ACT.

A problem with downhole packers can be extrusion (migration) of packer sealing elements into an annular gap between the packer body and the wellbore casing. The amount of extrusion can be a function of the differential pressure, working temperature, and size of the annular gap to the casing inside diameter. A back-up ring (e.g., top seal 402) can reduce extrusion and therefore promote holding a seal stack (e.g., having flexible or elastomeric seals, such as seals 404) to the outlined shape of the seal stack.

The bottom seal 406 is a bottom adapter backup ring that can be PEEK, PTFE, or ACT. A function of the bottom seal 406 may be to promote a uniform pressure distribution cross the seal stack 400. A benefit of uniform pressure distribution can be providing for less sensitivity to variation in fluid and other pressure and improve the tendency to deflect in the radial direction.

Figure 5:
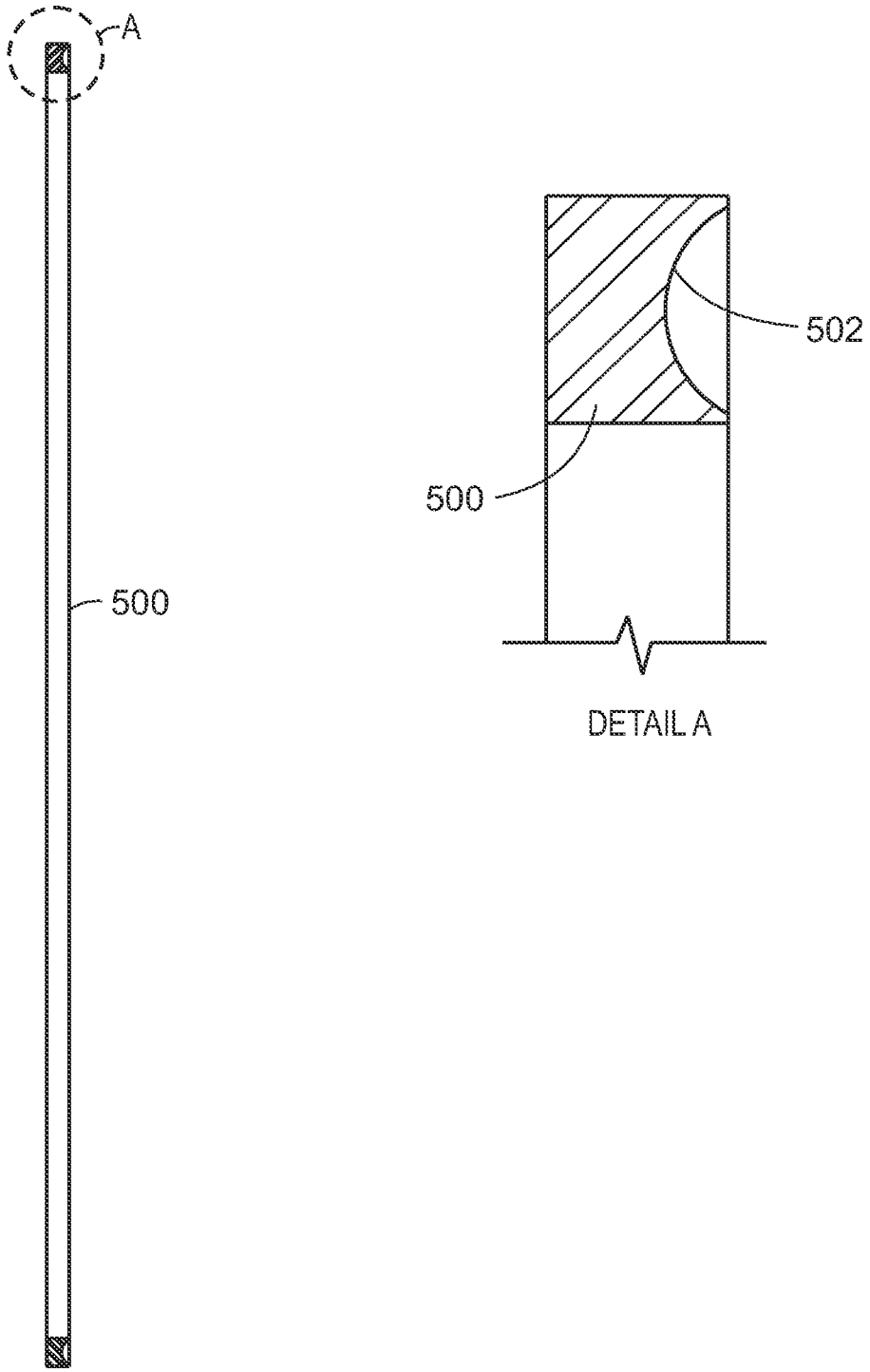
FIGS. 5, 6A, and 6B are diagrams of a backup ring for an O-ring, and in which the backup ring includes ACT.
Figure 6A:
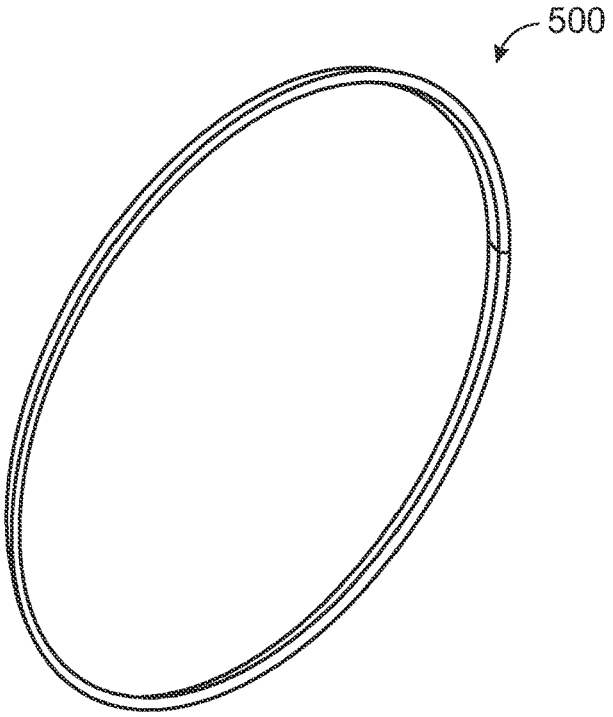
Figure 6B:
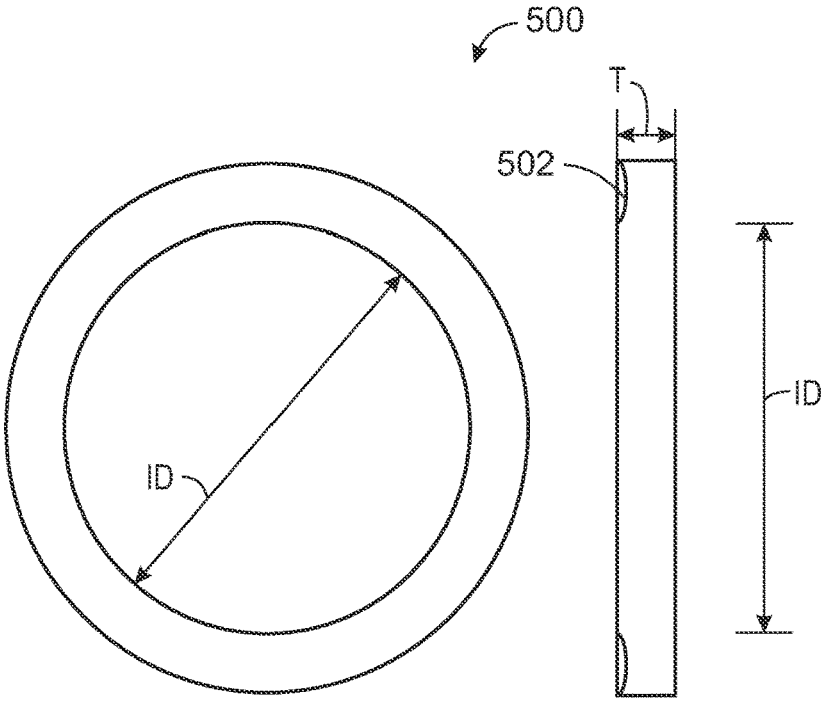

FIGS. 5, 6A, and 6B are a backup ring 500 for an O-ring in a downhole tool. The O-ring backup ring 500 can be or include ACT, such as ATSP. The backup ring 500 may generally be configured to fit between the O-ring and the extrusion gap and prevent or reduce extrusion of the O-ring. FIG. 5 shows the O-ring backup ring 500 as having a groove 502. The groove 502 is a cavity to receive or interface with the O-ring. FIG. 6A is a perspective view of the backup ring 500. FIG. 6B gives front and side views. The backup ring 500 has an inner diameter (ID) and a thickness (T). The groove 502 has a radius.

Figure 7:
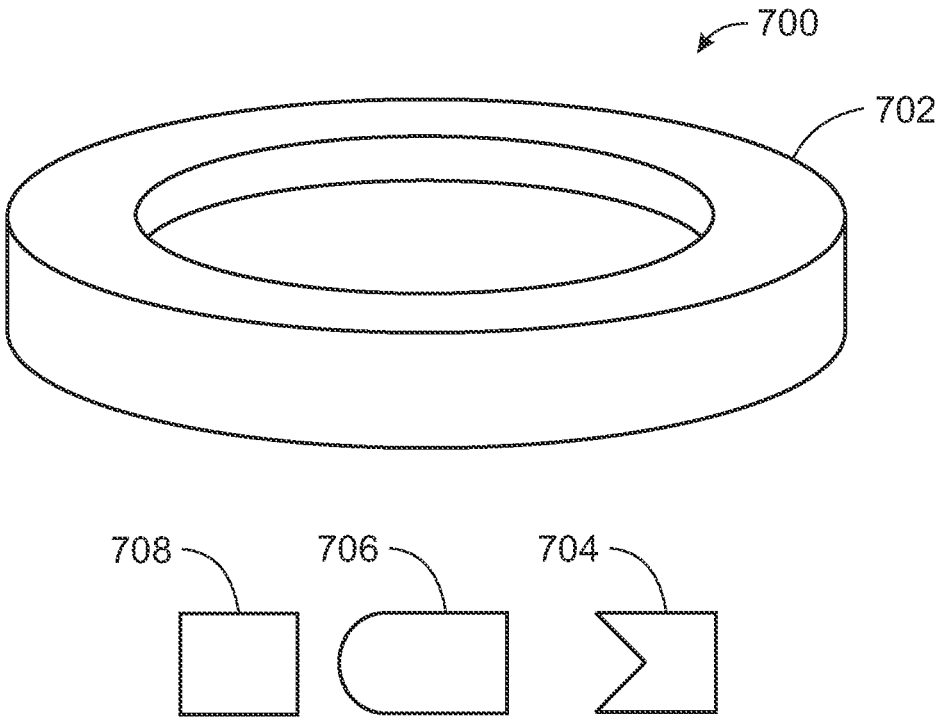
FIG. 7 is diagrams of a seal or sealing element that can include ACT. The sealing element is for a downhole tool, such as a packer.

FIG. 7 is a seal or sealing element 700 that can include ACT. The sealing element 700 is for a downhole tool, such as packer. As depicted, the sealing element 700 may have a generally annular body 702 (e.g., ring-shaped, comprising a ring shape to be situated around a tool mandrel). In some embodiments, the annular body 702 may be circular and/or hollow. In examples, the sealing element 700 may be configured with cross-sectional shapes. For instance, the sealing element 700 may have a cross-section similar in shape to V-shape 704, D-shape 706, square 708, an irregular shape, and/or combinations thereof.

FIGS. 8A-8D are each a composite seal having bonded seals. FIGS. 8A-8D depict representation of application of heat and pressure to bond an ACT seal with different materials, respectively, to give the composite seal. The composite seal may be characterized overall as a bonded seal in that the composite seal includes multiple seals bonded together.

ACT combines continuous amorphous and liquid crystal segments and hence offers a hybrid of properties commonly found among both thermosets and thermoplastics. Post curing after the crosslinking, ACT behaves as a thermoplastic and can be joined with different materials with the application of heat and pressure. An advantage over thermoplastics is generally better bonding with packer elastomeric elements. ACT can be used as a coating material on the different seals to realize a bonded seal with an elastomeric seal or a metallic insert. For forming the bonding, heat can be applied through a conduction heater, convection heater, ultrasonic heater, infrared heater, eddy current heater, and laser. The pressure and temperature implemented may depend on the type of coating formulation utilized which can be tailored based, for example, on the glass transition temperature.

Figure 8A:
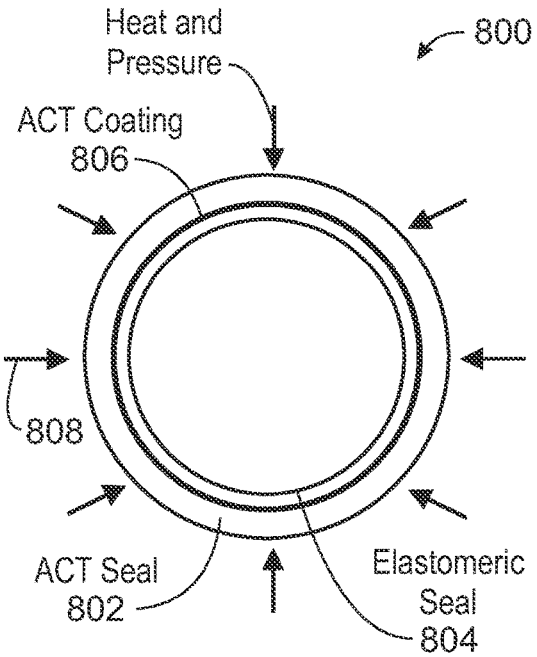
FIGS. 8A, 8B, 8C, and 8D are each a diagram of a respective composite seal having a bonded ACT seal.

FIG. 8A is a composite seal 800 including an ACT seal 802 bonded to an elastomeric seal 804 via (by means of) an ACT coating 806 on the elastomeric seal 804. Heat and pressure may be applied, as indicated by arrows 808, to form the composite seal 800. The applied heat and pressure can promote the bonding of the ACT seal 802 to the elastomeric seal 804 via the ACT coating 806. The ACT seal 802 is a seal that is or includes ACT. The ACT seal 802 can include reinforcement material (e.g., fibers) in implementations.

Figure 8B:
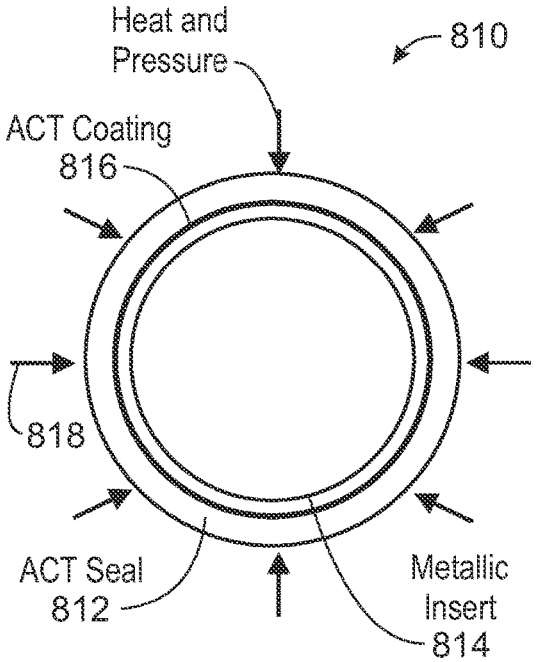

FIG. 8B is a composite seal 810 including an ACT seal 812 bonded to a metal insert 814 ring via an ACT coating 806 on the metal insert 814. Heat and pressure may be applied, as indicated by arrows 818, to form the composite seal 810. The applied heat and pressure can promote the bonding of the ACT seal 812 to the metal insert 814 by the ACT coating 816. The ACT seal 812 is a seal that is or includes ACT. The ACT seal 812 can include reinforcement material (e.g., fibers) in implementations.

Figure 8C:
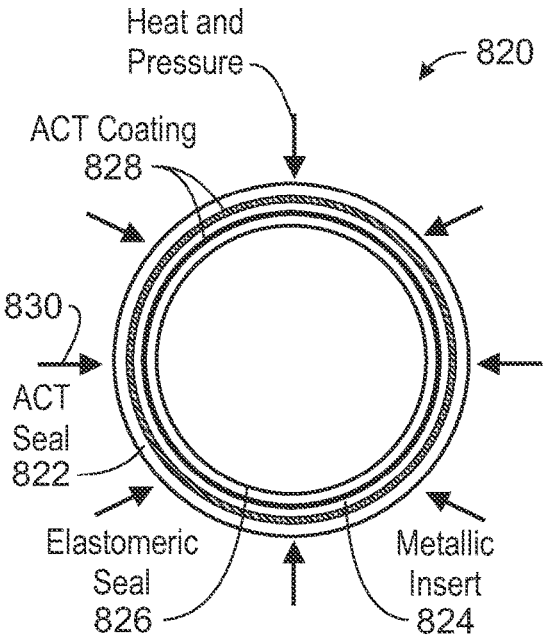

FIG. 8C is a composite seal 820 including an ACT seal 822 bonded to a metallic insert 824 (e.g., ring) with one bond. The metallic insert 824 is bonded to an elastomeric seal 826 with a second bond. The ACT seal 822 is a seal that is or includes ACT, and can include reinforcement material if desired. The two bonds are via a respective ACT coating 828. In particular, the ACT seal 822 is bonded to the metallic insert 824 by an ACT coating 828 on the metallic insert 824. The metallic insert 824 is bonded to elastomeric seal 826 by an ACT coating 828 on the elastomeric seal (and/or on the inside diameter surface of the metallic insert 824). Heat and pressure may be applied, as indicated by arrows 830, to form the composite seal 820. The applied heat and pressure can promote the bonding by the ACT coatings 826.

Figure 8D:
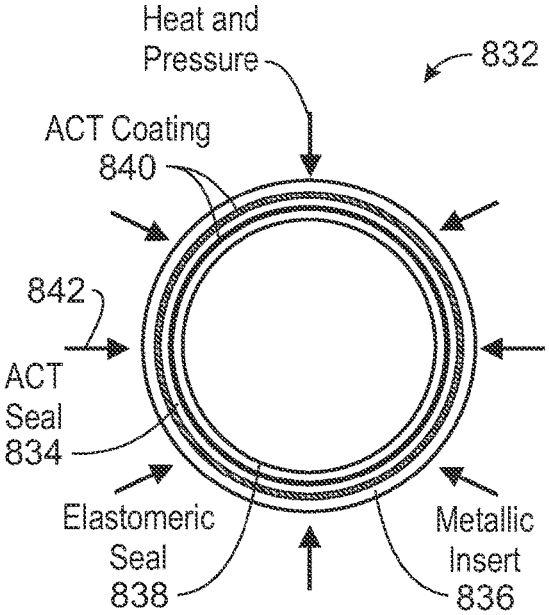

FIG. 8D is a composite seal 832 including an ACT seal 834 disposed between a metallic insert 836 ring and an elastomeric seal 838. The ACT seal 834 is a seal that is or includes ACT, and can include reinforcement material (e.g., fibers) if desired. The ACT seal 834 is bonded to the metal insert 836 by an ACT coating 840 on the inside diameter of the metal insert 836. The ACT seal 834 is bonded to the elastomeric seal 836 by an ACT coating 840 on the outside diameter of the elastomeric seal 838. Heat and pressure may be applied, as indicated by arrows 842, to form the composite seal 832. The applied heat and pressure can promote the bonding by the ACT coatings 840.

FIGS. 9A-9D are a time sequence of a molding assembly 900 in forming (e.g., via injection molding) a molded part 902 that includes ACT and that can be a sealing element for a downhole tool. The shape of the molded part 902 can be different than depicted to satisfy the shape desired. The shape of the molded part 902 can be generally a ring shape or other shape.

ACT seals may be manufactured from ACT. The ACT may be labeled as ACT resin or ACT polymer, such as ATSP resin or ATSP polymer. The ACT seals generally have greater temperature resistance than conventional elastomeric seals. The ACT seals can have reinforcement material in the ACT, and thus be a reinforced seal as a reinforced ACT seal. The reinforcement material can include, for example, carbon fibers, glass fibers, aramid fibers (aromatic polyamide), etc., or any combinations thereof. Kevlar® fibers are an example of aramid fibers. The ACT seals may be unfilled ACT seals (no reinforcement) or reinforced ACT seals. Manufacturing techniques for forming ACT billets or ACT seals (with or without reinforcement material) may include, for example, injection molding, compression molding, extrusion, and so forth. In implementations, a grade of the ACT seal may be injection molded grades, compression molded grades, or extrusion-based grades.

Figure 9A:
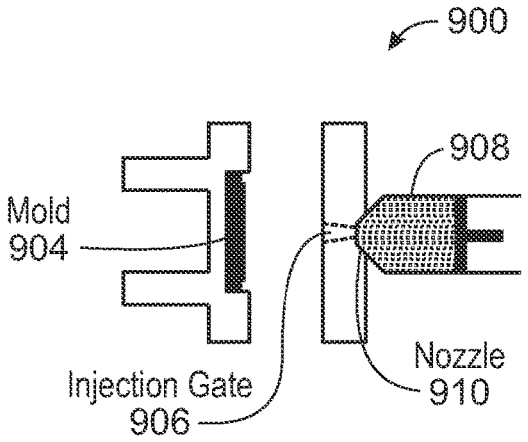
FIGS. 9A, 9B, 9C, and 9D are respective diagrams collectively depicting a time sequence of a molding assembly forming a molded part that includes ACT.

FIG. 9A is the mold assembly 900 initially at time A in an open position before injection. Such an open position may occur to remove a molded part 902 previously formed. The mold assembly 900 includes a mold 904 and an injection gate 906. An injector 908 having an inside volume holds the ACT to be injected into the mold 904 to form the molded part 902 (FIG. 9D). The injector 908 includes a nozzle 910 that interfaces with the injection gate 906 to fluidically couple the injection gate 906 with the inside volume of the injector 908.

Figure 9B:
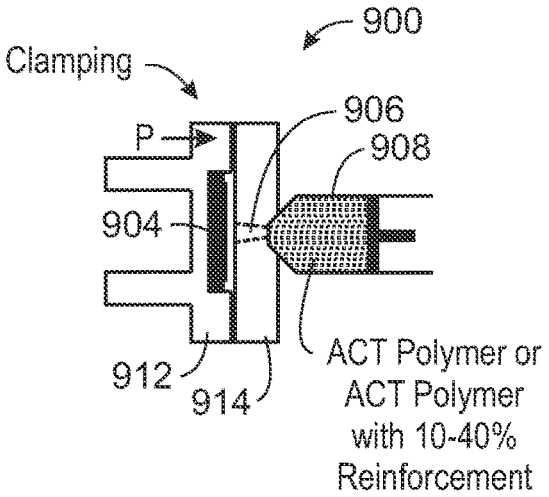

FIG. 9B is the mold assembly 900 at time B after time A. The mold assembly 900 is closed in preparation for injection. The mold assembly 900 includes a first portion 912 having the mold 904 (mold cavity) and a second portion 914 having the injection gate 906. The depicted closed position of the mold assembly 900 in FIG. 9B may be characterized as clamping such that the first portion 912 contacts or applies pressure to the second portion 914. The ACT in the injector 908 may be labeled as ACT polymer or ACT resin. The ACT in the injector 908 can include reinforcement material (e.g., the aforementioned fibers), such as in the range of 10 weight percent (wt %) to 40 wt %.

Figure 9C:
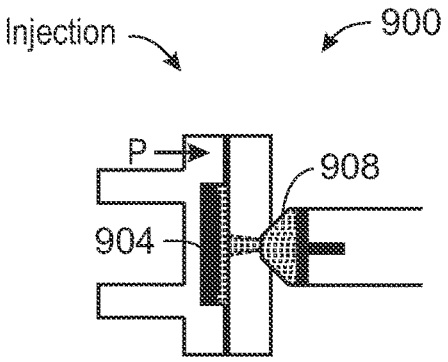
Figure 9D:
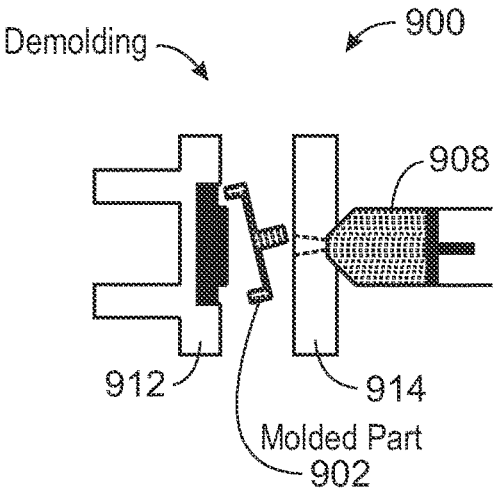

FIG. 9C is the mold assembly 900 at time C after time B. The mold assembly 900 is depicted with the ACT (with any reinforcement material) being injected from the injector 908 inside volume through the injector 908 nozzle and the injection gate 906 into the mold 904. In implementations, the ACT may be displaced from the injector 908 by a piston, such as a hydraulic-driven piston.

FIG. 9D is the mold assembly 900 at time D after time C. The mold assembly 900 is shown opened with the molded part 902 being removed or ejected from the mold 904. In the depicted open position, the first portion 912 is not in contact with the second portion 914.

Figure 10A:
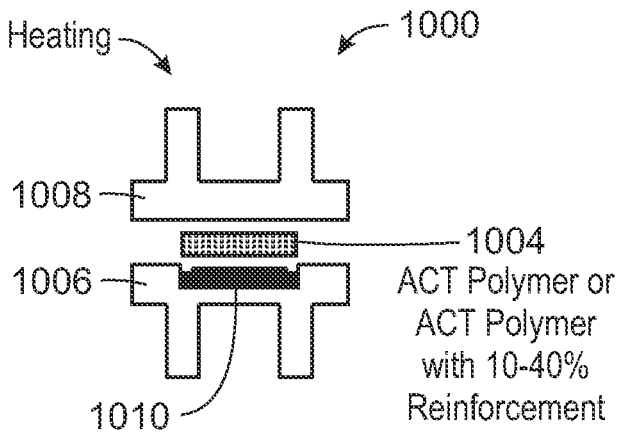
FIGS. 10A, 10B, and 10C are respective diagrams collectively depicting a time sequence of a molding assembly forming a molded part that includes ACT.
Figure 10B:
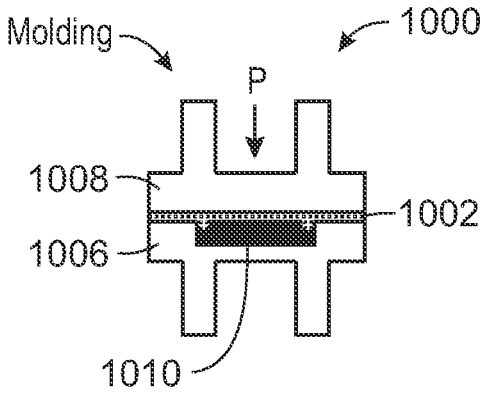
Figure 10C:
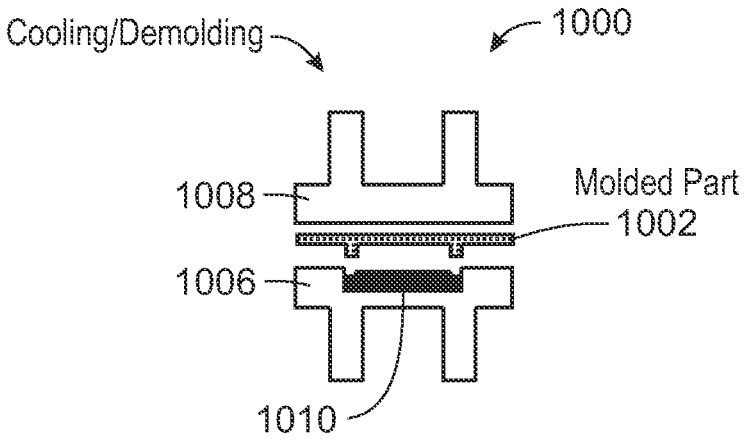

FIGS. 10A-10C are a time sequence of a molding assembly 1000 in forming (e.g., via compression molding) a molded part 1002 that includes ACT and that can be a sealing element for a downhole tool. The shape of the molded part 1002 can be different than depicted to satisfy the shape desired.

FIG. 10A depicts the mold assembly 1000 in an open position at time A to receive ACT 1004. The ACT 1004 can include reinforcement material, as discussed, e.g., in the range of 10 wt % to 40 wt %. The molding assembly 1000 includes a first portion 1006 and a second portion 1008 that generally mate or interface with each other. The first portion 1006 includes a mold 1010. The ACT 1004 is received between the first portion 1006 and the second portion 1008. The portions 1006, 1008 can be heated before and during the introduction of the ACT 1004.

FIG. 10B depicts the mold assembly 1000 in a closed position at time B after time A. In the illustrated implementation, the second portion 1008 is moved towards the second portion to close mold assembly 1000 to apply pressure to the received ACT 1004. The ACT 1004 is compressed between the first portion 1006 and the second portion 1008, and against the mold 1010. This compression gives the shape of the molded part 1002.

FIG. 10C depicts the mold assembly 1000 in an open position at time C after time B to remove or eject the molded part 1002. The molding assembly 1000 can be cooled before and during the removal of the molded part 1002.

An embodiment is a method of sealing a borehole. The sealing of the borehole may involve forming a fluid seal in the borehole. The method includes moving a tool mandrel of a downhole tool to a selected position in the borehole, wherein a sealing element (e.g., having an annular body) is disposed about the tool mandrel. The sealing element includes ACT resin. The selected position can involve depth in the borehole in implementations. The method includes positioning the sealing element in the borehole to form a seal between the sealing element and an adjacent surface (e.g., a surface of a liner or casing in the borehole). In implementations, the sealing element includes fibers (e.g., carbon fibers, glass fibers, and/or aramid fibers, etc.) as reinforcement material in the ACT resin. The sealing element may include, for example, 10 wt % to 40 wt % of the fibers. In implementations, the downhole tool has a seal stack disposed about the tool mandrel, wherein the seal stack includes the sealing element and a second sealing element that includes an elastomer. In implementations, the sealing element has a first seal ring including the ACT resin and a second seal ring including a metal or an elastomer, wherein the first seal ring is bonded to the second seal ring by a coating of the ACT resin on the second seal ring. In implementations, the downhole tool is a packer. In implementations, the downhole tool has a backup ring for an O-ring, wherein the backup ring includes an ACT.

In addition to seals and backup rings including ACT, bellows and other similar machined or molded components for downhole tools may include ACT. As for manufacturing ACT seals, additive manufacturing, such as three-dimensional (3D) printing, may be applicable. Applicable 3D printing for manufacturing ACT seals may include, for example, selective laser sintering (SLS), selective laser melting (SLM), and so on. Moreover, as indicated, seals for downhole tools in implementations can be made from composite sheets of continuous fiber (e.g., carbon, glass, aramid, etc.) and ACT for improved mechanical properties.

In addition to the aforementioned fibers utilized as reinforcement, other types of reinforcement or fillers may be included in the ACT. The other types may include, for instance, micro-fillers (particles or micro-tubes) and nano-fillers (particles or nanotubes), such as carbon black, graphite, graphene, glass, silica, pigment, or other nanotubes. These particles are nanotubes can be mixed with base ACT polymer to improve the mechanical, electrical, and thermal performance. Also, for downhole tool components, ACT can be utilized as a bonding agent for composite-to-metal, composite-to-composite, and metal-to-metal.

The oligomers crosslinked to give the ACT may be initially formed, for example, by reacting precursor monomers 1,4-phenylene diacetate (HQDA), [1,1'-biphenyl]-4, 4-acetoxybenzoic acid (ABA), trimesic acid (TMA), and/or isophthalic acid (IPA) into cross-linkable low-molecular weight oligomers.

In particular implementations, ACT may be produced by a two-part oligomerization process wherein branched aromatic crosslinkable copolyester oligomers are synthesized in a melt with average molecular weights between 1000 and 2000 gram per mole (g/mol) with monomer feed ratios selected such that the oligomers preferentially are capped with either carboxylic acid or acetoxy functional groups. These are synthesized with an initial feed of TMA, ABA, IPA, and biphenol diacetate (BPDA). As an example, an oligomer structure designated "CB" (carboxylic acid-capped) oligomers can be synthesized by melt-condensation of TMA, ABA, IPA and BPDA (molar ratio 1:3:2:2, respectively). "AB" (acetoxy-capped) oligomers can be synthesized similarly with a molar ratio 1:3:0:3.

In implementations, the ACT may be [1] an aromatic thermosetting copolyester comprising a first oligomer having a carboxylic acid end group and a second oligomer having an acetoxy end group, wherein the ratio of carboxylic acid end groups to acetoxy end groups is greater than 1:1, and wherein the first and second oligomers are both formed from at least four monomers and wherein one of the at least four monomers in both the first and second oligomers is biphenol diacetate (BPDA), and/or [2] an aromatic thermosetting copolyester comprising a first oligomer having a carboxylic acid end group and a second oligomer having an acetoxy end group, wherein the ratio of carboxylic acid end groups to acetoxy end groups is smaller than 1:1, and wherein the first and second oligomers are both formed from at least four monomers and wherein one of the at least four monomers in both the first and second oligomers is BPDA.

A feature of ATSP as a cross-linked aromatic copolyester can be ability to undergo further processing in the solid state through interchain transesterification reactions. ATSP can be characterized as a vitrimer. Vitrimers are a class of plastics, which are derived from thermosetting polymers (thermosets) and are very similar to them. Vitrimers may include molecular covalent networks that can change their topology by thermally activated bond-exchange reactions. Thus, vitrimers may be crosslinked polymers featuring dynamic covalent chemistry which allows changes in network topology via thermally-driven bond exchange. Subsequent process operations after cure may be mediated by a bond exchange reaction, which normally have a fixed topology. However, when heated above their $T_g$, a transition from viscoelastic solid to viscoelastic liquid may be realized, facilitating thermoplastic-like processing, such as compression, extrusion, and laminated molding.

Accordingly, the present disclosure may provide sealing elements that include an ACT. The methods, systems, and tools may include any of the various features disclosed herein, including one or more of the following statements.

Statement 1. A downhole tool for use in a borehole, comprising: a mandrel; and a sealing element disposed about the mandrel, wherein the sealing element comprises an aromatic copolyester thermoset (ACT).

Statement 2. The downhole tool of statement 1, wherein the ACT comprises an aromatic thermosetting copolyester (ATSP) resin.

Statement 3. The downhole tool of statement 1 or statement 2, wherein the sealing element comprises an annular body, and/or wherein the sealing element is configured to interface with the borehole to form a fluid seal in the borehole.

Statement 4. The downhole tool of any preceding statement, wherein the downhole tool comprises a seal stack disposed about the mandrel, wherein the seal stack comprises the sealing element and a second sealing element that comprises an elastomer.

Statement 5. The downhole tool of any preceding statement, wherein the sealing element comprises fibers as reinforcement material in the ACT.

Statement 6. The downhole tool of statement 5, wherein the sealing element comprises 10 weight percent (wt %) to 40 wt % of the fibers.

Statement 7. The downhole tool of statement 5 or statement 6, wherein the fibers comprise carbon fibers, glass fibers, or aramid fibers, or any combinations thereof.

Statement 8. The downhole tool of any preceding statement, wherein the downhole tool is a packer.

Statement 9. The downhole tool of any preceding statement, wherein the sealing element comprises a first seal ring comprising the ACT and a second seal ring comprising a metal or an elastomer, wherein the first seal ring is bonded to the second seal ring by a coating of the aromatic thermosetting copolyester resin on the second seal ring.

Statement 10. The downhole tool of any preceding statement, comprising a backup ring for an O-ring, the backup ring comprising an ACT.

Statement 11. A method of sealing a borehole, comprising: moving a tool mandrel of a downhole tool to a selected position in the borehole, wherein a sealing element is disposed about the tool mandrel, wherein the sealing element comprises an aromatic copolyester thermoset (ACT); and positioning the sealing element in the borehole to form a seal between the sealing element and an adjacent surface.

Statement 12. The method of statement 11, wherein the ACT comprises an aromatic thermosetting copolyester (ATSP).

Statement 13. The method of statement 11 or statement 12, wherein the sealing element comprises an annular body, and wherein the adjacent surface comprises a liner or casing in the borehole.

Statement 14. The method of any one of statements 11-13, wherein the downhole tool comprises a seal stack disposed about the tool mandrel, wherein the seal stack comprises the sealing element and a second sealing element that comprises an elastomer.

Statement 15. The method of claim any one of statements 11-14, wherein the sealing element comprises fibers as reinforcement material in the ACT.

Statement 16. The method of statement 15, wherein the sealing element comprises 10 weight percent (wt %) to 40 wt % of the fibers.

Statement 17. The method of statement 15 or statement 16, wherein the fibers comprise carbon fibers, glass fibers, or aramid fibers, or any combinations thereof.

Statement 18. The method of any one of statements 11-17, wherein the downhole tool is a packer.

Statement 19. The method of any one of statements 11-18, wherein the sealing element comprises a first seal ring comprising the ACT and a second seal ring comprising a metal or an elastomer, wherein the first seal ring is bonded to the second seal ring by a coating of the ACT on the second seal ring, and wherein the ACT comprises an ATSP resin.

Statement 20. The method of any one of statements 11-19, wherein the downhole tool comprises a backup ring for an O-ring, the backup ring comprising an ACT.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool for use in a borehole, comprising:

a mandrel; and a sealing element disposed about the mandrel to form a seal downhole in the borehole, wherein the sealing element comprises a seal stack comprising:

an elastomer; and an aromatic copolyester thermoset (ACT) as a backup to the elastomer, wherein the ACT is a vitrimer and comprises a glass transition temperature in a range of 170° C. to 307° C., wherein the seal stack comprises a first seal ring comprising the ACT, a second seal ring comprising the elastomer, and a third seal ring comprising a second elastomer softer than the elastomer.

2. The downhole tool of claim 1, wherein the ACT comprises an aromatic thermosetting copolyester (ATSP) resin comprising a carboxylic acid functional group as a first end group and an acetoxy functional group as a second end group, and wherein the sealing element is configured to interface with the borehole to form the seal comprising a fluid seal downhole in the borehole between the seal stack and a liner, a casing, or a borehole wall of the borehole, or any combinations thereof.

3. The downhole tool of claim 1, wherein the sealing element comprises fibers as reinforcement material in the ACT, wherein the fibers comprise carbon fibers, glass fibers, or aramid fibers, or any combinations thereof, wherein the downhole tool is a packer or an expandable liner hanger, and wherein the ACT comprises molded ACT, three dimensional (3D) printed ACT, or machined ACT.

4. The downhole tool of claim 1, wherein the seal stack comprises a spacer ring.

5. The downhole tool of claim 1, wherein the seal stack comprises the second seal ring and the third seal ring as adjacent seal rings.

6. The downhole tool of claim 1, wherein the seal stack comprises multiple seal rings each comprising the elastomer.

7. The downhole tool of claim 1, further comprising a backup ring for an O-ring, the backup ring comprising an ACT.

8. A downhole tool for use in a borehole, comprising:

a mandrel; and a sealing element disposed about the mandrel to form a seal downhole in the borehole, wherein the sealing element comprises a seal stack comprising:

a first seal ring comprising an aromatic copolyester thermoset (ACT) for anti-extrusion;

a second seal ring comprising an elastomer, wherein the first seal ring is bonded to the second seal ring by an ACT coating on the second seal ring; and a third seal ring comprising a second elastomer.

9. A method of sealing a borehole, comprising:

moving a tool mandrel of a downhole tool to a selected position in the borehole, wherein a sealing element is disposed about the tool mandrel, wherein the sealing element comprises a seal stack comprising:

an elastomer; and an aromatic copolyester thermoset (ACT) as a backup to the elastomer, wherein the ACT is a vitrimer and comprises a glass transition temperature of in a range of 170° C. to 307° C., and wherein the seal stack comprises a first seal ring comprising the ACT, a second seal ring comprising the elastomer, and a third seal ring comprising a second elastomer softer than the elastomer; and positioning the sealing element in the borehole to form a seal between the sealing element and an adjacent surface comprising a liner or casing in the borehole, wherein the ACT resists extrusion of the elastomer.

10. The method of claim 9, wherein the seal stack comprises multiple seal rings each comprising the elastomer, and wherein the ACT comprises an aromatic thermosetting copolyester (ATSP) comprising a carboxylic acid end group and an acetoxy end group.

11. The method of claim 9, wherein the seal stack comprises the second seal ring and the third seal ring as adjacent seal rings, and wherein the sealing element comprises fibers as reinforcement material in the ACT.

12. The method of claim 11, wherein the sealing element comprises 10 weight percent (wt %) to 40 wt % of the fibers, and wherein the ACT comprises a carboxylic acid end group.

13. The method of claim 11, wherein the fibers comprise carbon fibers, glass fibers, or aramid fibers, or any combinations thereof, and wherein the sealing element comprises molded ACT or three dimensional (3D) printed ACT.

14. The method of claim 9, wherein the downhole tool is a packer or an expandable liner hanger, and wherein the seal stack comprises a spacer ring.

15. The method of claim 9, wherein the first seal ring is bonded to the second seal ring by an ACT coating on the second seal ring, and wherein the ACT comprises an ATSP resin.

16. The method of claim 9, wherein the downhole tool comprises a backup ring for an O-ring, the backup ring comprising an ACT.

* * * * *